United States Patent [19]

Santinelli

[11] 4,433,569

[45] Feb. 28, 1984

[54] CRIMPING TONGS

[75] Inventor: Joseph Santinelli, Valmondois, France

[73] Assignee: Mars Alcatel, Paris, France

[21] Appl. No.: 346,230

[22] Filed: Feb. 5, 1982

[30] Foreign Application Priority Data

Feb. 11, 1981 [FR] France ..... 81 02650

[51] Int. Cl.[3] ..... B21D 9/08

[52] U.S. Cl. ..... 72/410; 72/412; 74/17.5; 81/349; 81/373

[58] Field of Search ..... 72/410, 409, 412; 74/17.5; 81/57.39, 347, 349, 352, 355, 373, 374, 376, 314, 383.3; 101/3 SP

[56] References Cited

U.S. PATENT DOCUMENTS 3,101,017 8/1963 Malkin et al. ..... 81/349
3,359,779 12/1967 Filia ..... 72/412

FOREIGN PATENT DOCUMENTS 718809 3/1942 Fed. Rep. of Germany .
2144846 6/1973 Fed. Rep. of Germany .
1276554 10/1961 France .
1342312 9/1963 France .
1380894 10/1964 France .

*Primary Examiner*—Daniel C. Crane
*Assistant Examiner*—David B. Jones
*Attorney, Agent, or Firm*—Kenyon & Kenyon

[57] ABSTRACT

Crimping tongs in particular for crimping a sleeve on a cable, said tongs having jaws coupled to each other so that one moves relatively to the other, a cam (15) driven by a ratchet wheel (16) which actuates a toggle joint device (20,21,22) a catch being installed on the moving handle (13) so as to drive the ratchet wheel step by step by moving the moving handle, the toggle joint device making the moving jaw (12) rotate in the closing direction. With a view to axial crimping, the moving jaw (12) has a moving die (14) which moves rectilinearly. A spring (25) biases the toggle joint to move the one jaw toward the other, and a trigger (19) is pressed to open the jaws sufficiently for insertion of a sleeve to be crimped. Releasing the trigger causes the jaws to hold the sleeve under the action of spring (25); so that the crimping action can be performed with one hand.

6 Claims, 6 Drawing Figures

CRIMPING TONGS

The invention relates to crimping tongs, in particular for crimping insulated or non-insulated sleeves which are designed to connect electric cables together.

BACKGROUND OF THE INVENTION

Known tongs usually have two jaws which remain open in the rest position and are closed together by pivoting to crimp. In the jaws' open position, the sleeve to be crimped is not held. It is therefore necessary to position it and to hold it by hand until it is clamped by the jaws.

The invention aims to produce tongs which crimp axially.

The invention also aims to produce tongs whose jaws are closed in the rest position so that the sleeve to be crimped can be positioned in the tongs before crimping, thereby enabling the operator to hold the tongs in one hand, leaving the other hand free.

SUMMARY OF THE INVENTION

The invention provides crimping tongs in particular for crimping a sleeve on a cable, said tongs having a stationary handle and a moving handle, a stationary jaw and a moving jaw which pivots on a pin, a cam driven by a ratchet wheel which actuates a toggle joint device, an advance catch being installed on the moving handle so as to drive the ratchet wheel which is held by a retaining catch, the toggle joint device making the moving jaw rotate, wherein said tongs have a moving die slidably mounted in stationary grooves with a view to axial crimping, the rotation of the moving jaw pushing the moving die rectilinearly towards the stationary jaw when the tongs close and a link between a moving die and a moving jaw by which said moving die is withdrawn when the tongs open.

Preferably, the moving die is slidably mounted in grooves, the moving jaw pushing on the moving die to close and a link between die and jaw which link moves the moving die away when the moving jaw opens.

In the rest position, the moving jaw may be closed by a spring, a trigger opening the moving jaw to insert the sleeve which is to be crimped between the jaws, the sleeve being held in the crimping position in the tongs when the trigger is released.

BRIEF DESCRIPTION OF THE DRAWINGS

A preferred embodiment of the invention is described below by way of a non-limiting example with reference to the accompanying drawings in which.

MORE DETAILED DESCRIPTION

Figure 1:
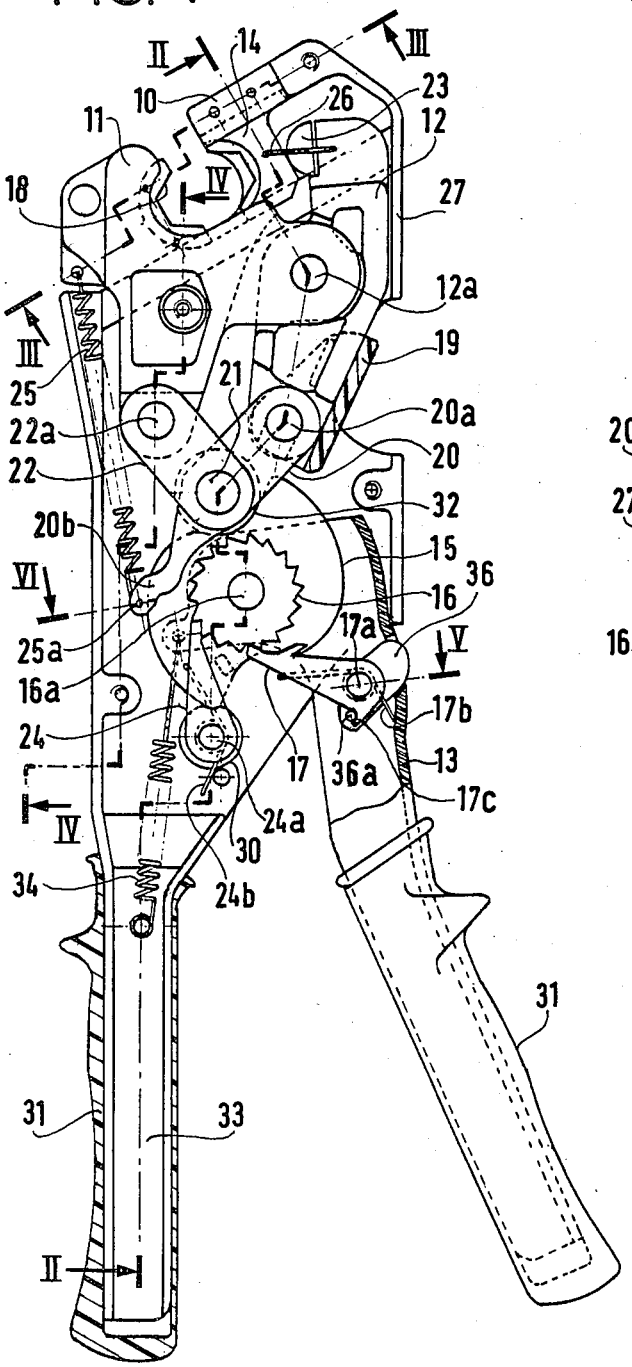
FIG. 1 is a side view of tongs in accordance with the invention.

With reference to the drawings, the tongs have a stationary jaw 11 and a moving jaw 12 controlled by a moving handle 13. The moving jaw 12 rotates about an axis 12*a* which moves a die 14 whose movement is axial in a groove of the stationary jaw 11 and in a groove of a wear part 10 fixed to the casing of the tongs. Said movement is obtained to axially crimp a sleeve (not shown) by moving the handle 13 by means of a cam 15 which is integral with a toothed wheel 16 installed on an axle 16*a* and made to move step by step by means of an advance catch 17 installed on an axle 17*a* of the handle 13 and urged by a spring 17*b* and a retaining catch 24 pivoting on a pin 24*a* and urged by a spring 24*b*.

A sleeve to be crimped is held in the tongs between a stationary die 18 and the moving die 14. A trigger 19 is depressed to open the moving jaw 12 against the tension of a spring 25 fixed by a pin 25*a* to one end 20*b* of a connecting rod 20, thereby opening the moving jaw and hence the moving die 14 to release the sleeve. Cam 15 is preferably a double cam so that two crimping operations are performed by moving the cam through a complete turn (360°). This reduces the number of manipulations of the moving handle by half.

Figure 2:
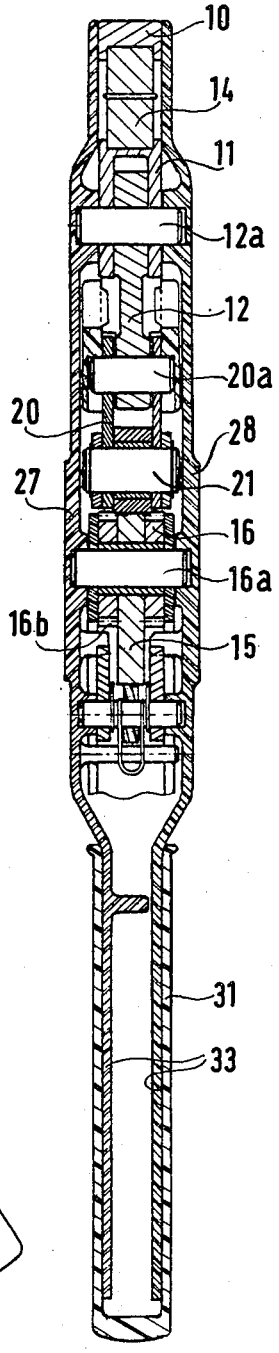
FIG. 2 is an edge view, in cross section, taken along line II—II of FIG. 1.
Figure 3:
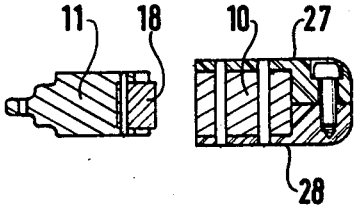
FIG. 3 is a cross-section of the jaws along line III—III of FIG. 1.
Figure 4:
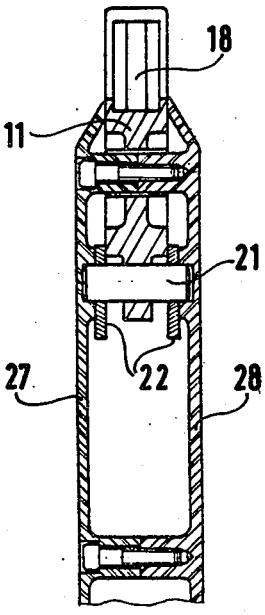
FIG. 4 is a cross-section along line IV—IV of FIG. 1.
Figure 5:
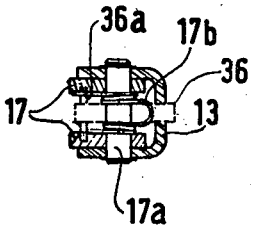
FIG. 5 is a partial cross-section along line V of FIG. 1.
Figure 6:
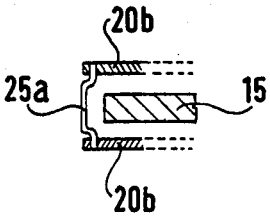
FIG. 6 is a partial cross-section along line VI of FIG. 1.

The double cam 15 actuates a moving roller 21 which with two connecting rods 20, 22 forms a toggle joint, the connecting rod 22 pivoting on a stationary axle 22*a* and the connecting rod 20 pivoting on an axle 20*a* of the moving jaw 12 which it pushes in the moving jaw closing direction. The end of said moving jaw has a semicylindrical portion 23 which bears against one side of the moving die 14, said moving die sliding in grooves in a straight line. The connecting rods 20, 22 can be twinned as illustrated in FIG. 2.

The double cam 15 is integral with one or two toothed wheels (16, 16*b*) disposed on either side of the cam. The advance catch 17 advances the double cam 15 step by step, always in the same direction when the moving handle 13 is actuated.

Depressing the trigger 19 brings the moving roller 21 of the connecting rod system into a hollow 32 of the double cam 15 while tensioning the spring 25.

A fixing device 26 can be provided between the moving jaw 12 and the moving die 14 to return the moving die when the moving jaw moves, or else a return spring can be provided to return the moving die.

The tongs are produced in the form of two cheeks 27, 28 made of light alloy or of a plastics substance which sandwiches the actual mechanism. For assembly, the mechanism can be placed in one cheek, then the second cheek can be placed on the first, after which the two cheeks are locked together by means of screws or of a fixing device. This facilitates assembly.

The guide 10 which acts as a wear part is interchangeably fixed between the cheeks 27,28. An elastic indiarubber ring 30 allows the double cam 15 to be stopped in a stationary position after the end of each half stroke of the cam. The tongs have insulating handles 31 fitted onto the stationary handle 33 and onto the moving handle 13 for operation on live cables.

A sleeve is placed in the tongs by pressing the trigger 19 so as to move the moving die away from the stationary die. Once the sleeve is in position, the trigger is released and the sleeve stays in its position in the tongs and clamped between the two dies due to the action of the spring 25. Crimping is performed by actuating the moving handle 13 which is fitted with a return spring 34. Said spring makes the toothed wheel 16 and therefore the cam 15 which is integral therewith progress step by step. Said step by step progression of of the half cam 15 produces a great closing force of the moving die towards the stationary die and crimps the sleeve. The second half cam allows a second crimping operation to be carried out.

Holding the sleeve which is to be crimped between the dies allows the sleeve to be more precisely positioned before crimping. It also allows one of the operator's hands to remain free. The tongs can thus be held in one hand by the operator while the sleeve is held between the dies 18 and 14 under the action of the tension spring 25.

However, it may be necessary to release the part to be crimped from the grip of the dies without performing the complete crimping operation such as described hereinabove. For this purpose, an axuiliary release trigger 36 is installed on the pin 17*a* and slightly protruding out of the moving handle. Said trigger has a stud 36*a* which engages a return latch 17*c* of the advance catch 17. The latch 17*c* is arranged so as to raise the catch 17 out of the teeth of the toothed wheel 16 and to make it push the retaining catch 24 back out of the teeth of the same toothed wheel 16 when the trigger 36 is actuated—in this case by pressure—and when the moving handle 13 is pressed towards the stationary handle 33. Since the cam 15 is no longer restrained, to apply reversing torque to said cam 15 via the roller 21 for opening the moving jaw 12, it is necessary only to press on the trigger 19.

What is claimed is:

1. A compression tool for crimping a sleeve onto a cable, the tool having a body with a stationary handle fixed thereto, a movable handle connected to the body for movement toward and away from the stationary handle, a pair of jaws mounted on the body, one jaw being movable toward and away from the other, a pair of hinged links situated at an angle and forming a toggle joint connecting said jaws, the toggle joint being operable to move said one jaw toward the other when the angle between the links is increased, a cam provided with a ratchet, the cam being rotatably mounted on said body for operating said toggle joint, a spring-biased advance catch connected to the movable handle and contacting the ratchet for rotating said cam when the movable handle is moved toward the stationary handle, and a spring-biased retainer catch connected to the body and contacting the ratchet for holding the cam when the movable handle is moved away from the stationary handle, wherein the improvement comprises:

a spring attached to the body and toggle joint and acting on the toggle joint to increase the angle between the links for urging the one jaw toward the other jaw and a trigger connected to the toggle joint such that pressure on the trigger will decrease the angle between the links against the force of the spring to move the one jaw away from the other to permit insertion of a sleeve for crimping between the jaws, subsequent release of the trigger allowing the force of the spring to hold the sleeve in crimping position between the jaws.

2. A compression tool according to claim 1 further comprising stationary grooves fixed to the body adjacent to said one jaw and directed toward said other jaw, a movable die slidably mounted in said grooves, and a link connecting the movable die to said one jaw such that movement of the one jaw toward and away from the other jaw by operation of the toggle joint causes movement of the moving die toward and away from said other jaw.

3. A compression tool according to claim 1 wherein said body comprises two one-piece cheeks of light alloy, and the jaws, toggle joint, cam, advance catch, and retainer catch are sandwiched between said cheeks.

4. A compression tool according to claim 1 wherein said body comprises two one-piece cheeks of a plastics substance, and the jaws, toggle joint, cam, advance catch, and retainer catch are sandwiched between said cheeks.

5. A compression tool according to claim 1 further comprising an auxiliary release trigger mounted for selective movement into engagement with the advance catch for disengaging the advance catch from the ratchet and means responsive to the disengagement of the advance catch for disengaging the retainer catch from the ratchet when the movable handle is moved toward the stationary handle.

6. A compression tool according to claim 5 wherein the advance catch comprises a pawl pivotally mounted on a stud fixed to the movable handle, the auxiliary release trigger is mounted on the same stud, and the means for disengaging the retainer catch from the ratchet when the movable handle is moved toward the stationary handle comprises said advance catch when in the disengaged position.

* * * * *